US005364305A

United States Patent [19]

Zieve

[11] Patent Number: 5,364,305

[45] Date of Patent: Nov. 15, 1994

[54] AIR MIXER

[76] Inventor: Edward R. Zieve, 500 Camp Brosius Rd., Elkhart Lake, Wis. 53020

[21] Appl. No.: 76,331

[22] Filed: Jun. 14, 1993

[51] Int. Cl.[5] ..... F24F 13/04

[52] U.S. Cl. ..... 454/261

[58] Field of Search ..... 454/261, 269, 299, 309

[56] References Cited

U.S. PATENT DOCUMENTS

| | | | |
|---|---|---|---|
| 2,195,411 | 4/1940 | Germonprez | 454/309 |
| 2,282,946 | 5/1942 | De Roo | 454/309 |
| 2,408,691 | 10/1946 | Shaw | 454/269 X |
| 4,495,858 | 7/1985 | Erickson | 454/261 |
| 4,991,496 | 2/1991 | Kuno et al. | 454/309 X |

FOREIGN PATENT DOCUMENTS

| | | | |
|---|---|---|---|
| 608088 | 5/1989 | Australia | 454/309 |

*Primary Examiner*—Harold Joyce
*Attorney, Agent, or Firm*—Wheeler & Kromholz

[57] ABSTRACT

An apparatus for mixing air streams in a duct or plenum of a heating, ventilating or air conditioning system is within a rectangular frame and comprises a centrally located square solid sided pyramid shaped deflector surrounded by four sets of air directing vanes, two long sets and two short sets, in rectangular apertures. The vanes divide oncoming air streams which pass through the rectangular apertures, along the vane's curved cross-sections, and are discharged at the vane's discharge angle toward the base of the pyramid shaped deflector. The pyramid shaped deflector divides the remaining oncoming air streams along each of its solid sides and directs the air streams into the mixing region. The divided air streams interface and mix in a region located around the pyramid shaped deflector's base to evenly temper air streams in a heating, ventilating or air conditioning system and distribute the mixed air uniformly across the downstream plenum or duct.

3 Claims, 1 Drawing Sheet

AIR MIXER

BACKGROUND OF THE INVENTION

Without the use of an air mixing device to prevent the stratification of air streams in a heating, ventilating or air conditioning system which utilizes both fresh and return air, many undesirable results are likely to occur. Examples include coil freeze ups caused by fresh air at a temperature below freezing, the circulation of unevenly tempered air such that some areas of a building receive warmer or cooler air than others, and the creation of non-uniform air stream velocities which prevent the efficient performance of downstream filters and coils. While other devices to prevent the stratification of air streams are available on the market, none do so in the same novel, effective, and efficient way as my invention.

One objective of my invention is to eliminate the stratification of air streams typically caused by the simultaneous introduction of fresh and return air into a heating, ventilating or air conditioning system. Elimination of stratification is achieved by properly mixing air streams of different temperatures such that one evenly tempered air stream is produced. My invention will produce an air stream within a range of 6 degrees Fahrenheit (F) or 3.33 degrees Celsius (C) standard deviation from the theoretical exact mixing temperature. Another objective is to distribute the mixed air streams more uniformly across the containing ductwork downstream of the mixer. Uniform air velocities entering filters and heating or cooling coils allow these components to operate more efficiently and minimize pressure losses in the system.

SUMMARY OF THE INVENTION

My invention, which is located within a frame having inner and outer rectangular regions, is an apparatus for mixing air streams. The apparatus has a centrally located pyramid shaped deflector surrounded by four sets of air stream directing vanes with curved cross-sections. Two first parallel sets parallel and span the longest side of the frame and two second parallel sets at right angles to the first sets span the space along the shorter sides between the first sets so that between each pyramid side and the parallel frame side there is a set of parallel vanes, with two such sets being much longer than the other two. The air stream directing vanes are spaced at fixed proportional distances from one another forming rectangular apertures through which the air streams flow. The vanes are arranged such that their curved cross-sections and discharge angles direct oncoming air currents toward the center of the region around the base of the pyramid shaped deflector. The centrally located pyramid shaped defector's apex lies within the plane of the frame. Additional rectangular openings are formed between the sides of the deflector and the neighboring four sets of vanes such that mixed air streams can pass between the two structures. Elongated structural members, with one end attached to the edge of the frame and the other to the base of the pyramid shaped deflector, are used to support the pyramid shaped deflector within the inner rectangular region of the frame. The combination and orientation of the structures and regions create an optimal mixing region around the base of the pyramid shaped deflector.

As oncoming air streams contact my air mixing invention, they are divided by its vanes and pyramid shaped deflector. The air streams at each side of the centrally located pyramid shaped deflector pass through the rectangular apertures between the vanes. They follow the curved cross-sections and discharge angles of the vanes and are directed inwardly toward the center of the mixing region around the base of the pyramid shaped deflector. The apex of the pyramid shaped deflector divides and directs the central portion of the air streams along each of the pyramid shaped deflector's solid triangular sides and into the mixing region. The apportioned air streams, which have passed through the rectangular apertures formed by the air directing vanes and are now traveling in different directions, collide in the mixing region at the pyramid shaped deflector's base. Optimal mixing occurs and one evenly tempered air stream is produced. The central portions of the air streams divided and directed by the pyramid shaped deflector also disperse the main mixed air mass to equalize duct cross sectional velocities continuing downstream.

My air mixer is designed to be installed in a ventilation duct or plenum of a heating, ventilating or air conditioning system. It is preferably, but not necessarily, located before the usual filtration system, coils, and fan. The length of the long side of the inner rectangular region is not to exceed approximately two times the length of the short side for optimum mixing to occur. The orientation of the sides can be interchanged. However, if the dimensions of an existing duct or plenum do not permit the installation of a mixer conforming to the above specification, the area may be divided into spaces of the required ratio so that a plurality of mixers, which individually conform to the above proportions and which collectively span the available area, can be used.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 3:
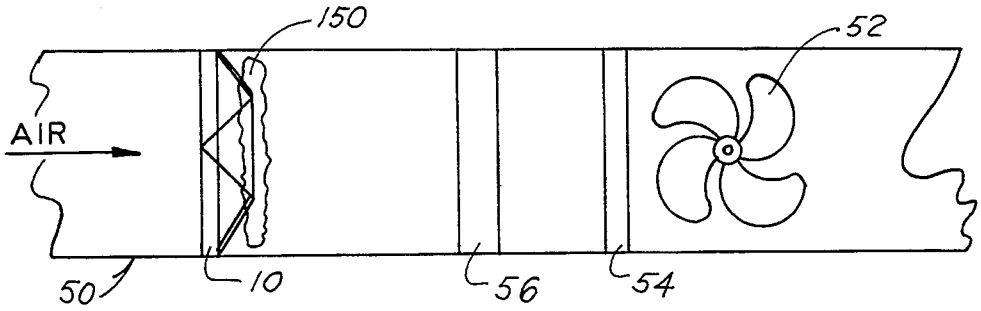
FIG. 3 is a side view of a typical heating, ventilating or air conditioning system incorporating my invention.

My air mixer has a body 10 which includes a rectangular frame 30 with inner and outer rectangular regions 70 and 36 respectively. The outer rectangular region 36 has outer edges 32, 34 and is designed to fit into a ventilation duct or plenum 50. As shown in FIG. 3, my invention is typically located preceding the fan 52, the heating and cooling coils 54, and filtration system 56 of a heating, ventilating or air conditioning system. However, my air mixer will still function properly if located after or between some or all of these components. While a small pressure drop due to the venturi-like construction of my invention results after the air streams pass through the air mixer, the elimination of stratification of air streams is a very desirable end which prevents problems such as coil freeze ups, and the distribution of unevenly tempered air streams, and the creation of unequal air velocities approaching downstream filters and coils.

Housed within rectangular region 70 is the mixing structure 130 of my invention. Rectangular region 70 comprises two parallel and equal sides 72 and two parallel and equal sides 74. Sides 72 and 74 form a rectangular interior edge 78. The length of sides 74 can vary between a value equal to sides 72 to a maximum of approximately twice the value of sides 72. The orientation of sides 72 and 74 can be interchanged without affecting the function of my invention. A plurality of my mixing structures 130 can be used to collectively span large ducts or plenums 50, or ducts or plenums in which the length requirements of sides 72 and 74 cannot be complied with by a single unit according to the aforementioned formula.

The mixing structure 130 adjoins interior edge 78 of frame 30. It comprises four sets of air direction changing vanes 200,210,220,230 and proportional rectangular apertures 100, a centrally located pyramid shaped deflector 110, four rectangular openings 120, and four elongated structural support members 160. Each vane 90 has a curved cross-section 92, a discharge angle 94, and is located at a fixed proportional distance from the next forming rectangular apertures 100. None of the structural components move or are adjustable. All components can be fabricated from any appropriately stiff material; e.g. steel, aluminum or plastic.

Figure 1:
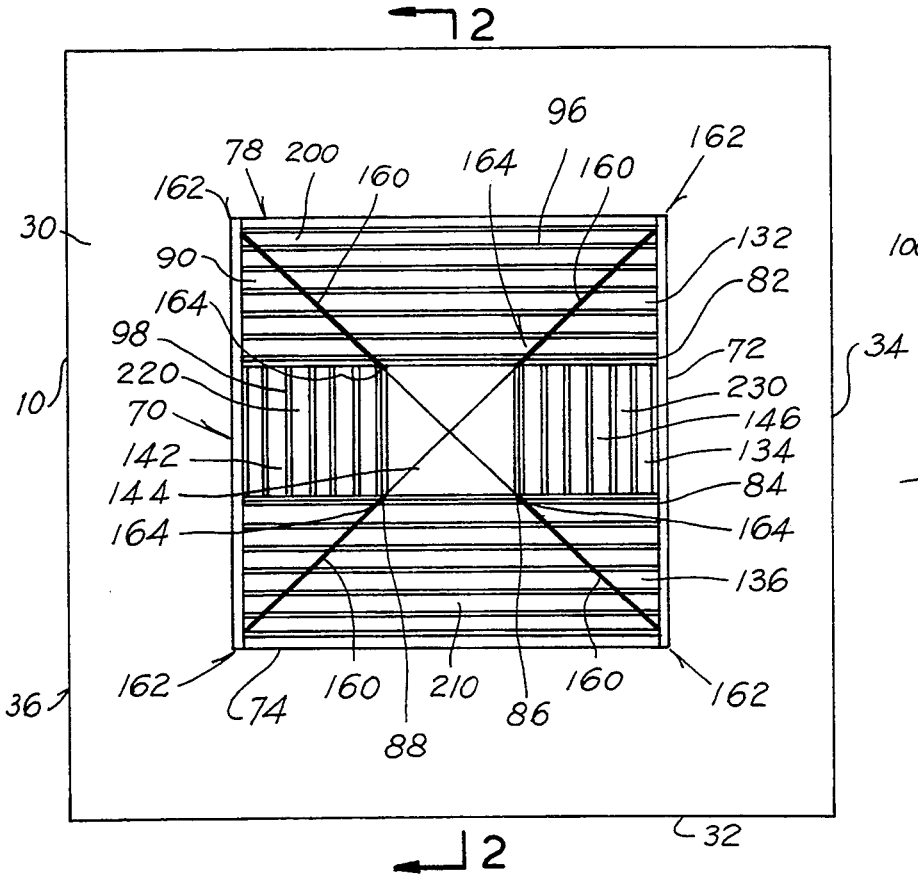
FIG. 1 is a frontal view of the air mixer.

As shown in FIG. 1, lines 82 and 84, perpendicular to sides 72 and parallel to sides 74 of rectangular region 70, divide the mixing structure 130 into three equivalent rectangular sections 132, 134, 136. The uppermost section 132 and lowermost section 136 contain a multiplicity of long air direction changing vanes 90 and long rectangular apertures 100 forming long sets 200 and 210. The longitudinal axes 96 of long vanes 90 and long apertures 100 are parallel to sides 74 and perpendicular to sides 72 of rectangular region 70. The oncoming air streams contacting sections 132 and 136 are divided by vanes 90, directed into rectangular apertures 100, along curved cross-sections 92, and discharged at discharge angles 94 inwardly toward mixing region 150 located around the base 114 of the pyramid shaped deflector 110.

The center rectangular section 134 is further divided into three smaller rectangular sections 142, 144, 146 by two lines 86 and 88 perpendicular to sides 74 and parallel to sides 72 of rectangular region 70 as shown in FIG. 1. The outermost rectangular sections 142 and 146 contain shorter air directional changing vanes 90 and shorter rectangular apertures 100 whose longitudinal axes 98 are oriented parallel to sides 72 and perpendicular to sides 74 of rectangular region 70. These shorter vanes and apertures, which form short sets 220 and 230, also direct oncoming air streams inwardly toward mixing region 150 located around the base 114 of the pyramid shaped deflector 110.

Figure 2:
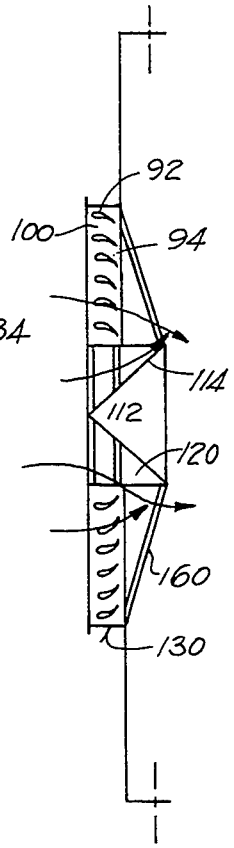
FIG. 2 is a cross-sectional view cut through the line 2—2 of FIG. 1.

The remaining centrally located rectangular section 144 contains a square four solid sided pyramid shaped deflector 110 whose apex 112 lies within the plane of frame 30 and expands radially outward beyond the frame of my invention. The square four solid sided pyramid shaped deflector 110 is attached to frame 30 by four elongated structural members 160, each extending from a corner of the inner region 70 of frame 30 located at 162 to a corresponding corner of the pyramid shaped deflector 110 located at 164 as shown in FIG. 1 and 2. Four rectangular openings 120 are formed between each solid side 116 of the pyramid deflector and the inner most air directing vane 90 of sets 200,210,220, and 230. One function of the centrally located four solid sided pyramid shaped deflector 110 is to divide the central air stream and outwardly direct separate oncoming air streams along each one of its solid sides 116 into mixing region 150 located around its base 114. In mixing region 150 these air streams interface with the air streams directed inwardly by the directional vanes 90 and optimal mixing is achieved. The other function of the centrally located pyramid shaped deflector 110 is to disperse the main mixed air mass and equalize downstream duct cross sectional velocities.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. An air mixer within a frame having inner and outer rectangular regions for mixing air streams, comprising:

four sets of vanes;

a plurality of rectangular apertures;

a center region within said inner rectangular region of said frame;

a pyramid shaped deflector having solid sides, a base, and an apex;

an opening;

a plurality of structural members;

a mixing region;

said inner rectangular region having two parallel and equal long sides and two parallel and equal short sides;

said long sides being a maximum of twice as long as said short sides;

said pyramid shaped deflector located in said center region;

said apex of said pyramid shaped deflector lying in the same plane as said frame and expanding radially outward beyond said frame;

said opening being between said solid sides of said pyramid shaped deflector and said inner rectangular region of said frame;

said sets of vanes comprising a plurality of vanes with curved cross-sections and discharge angles positioned at proportional distances from one another forming said rectangular apertures;

said rectangular apertures between said plurality of vanes being proportional to one another;

said inner rectangular region having an edge;

said first and second sets of vanes parallel and paralleling and spanning the longest sides of said inner rectangular region and extending from said edges of said long sides of said inner rectangular region to said base of said deflector;

said second and third sets at right angles to said first and second sets and spanning the spaces not occupied along the short sides of said inner rectangular region and extending from said edges of said short sides of said inner rectangular region to said base of said deflector;

each set of vanes discharge angle being directed inwardly;

said plurality of structural members each having a first and a second end;

said first end of said structural member being attached to said base of said pyramid shaped deflector;

said second end of said structural member being attached to said frame;

said mixing region located around said base of said pyramid shaped deflector where air streams divided and directed by said vanes, rectangular apertures, and pyramid shaped deflector converge.

2. The air mixer of claim 1, whereby all elements are fabricated from steel, aluminum or plastic.

3. The air mixer of claim 1, wherein a plurality of air mixers can be used to accommodate larger ducts and plenums.

* * * * *